US006138793A

United States Patent [19]

Apostolopoulos

[11] Patent Number: 6,138,793

[45] Date of Patent: Oct. 31, 2000

[54] WORK PLATFORM FOR USE ON BRIDGES

[75] Inventor: Lambros Apostolopoulos, Amherst, N.Y.

[73] Assignee: Paul Kristen, Inc., Tonawanda, N.Y.

[21] Appl. No.: 08/888,271

[22] Filed: Jul. 3, 1997

Related U.S. Application Data

[63] Continuation-in-part of application No. 08/506,685, Jul. 25, 1995, Pat. No. 5,730,248.

[51] Int. Cl.[7] ..... E04G 3/14

[52] U.S. Cl. ..... 182/150; 182/138

[58] Field of Search ..... 182/150, 138, 182/63.1, 2.6

[56] References Cited

U.S. PATENT DOCUMENTS

| | | | |
|---|---|---|---|
| 629,935 | 8/1899 | Sturgis . | |
| 1,697,977 | 1/1929 | Henryson | 211/119.01 |
| 2,479,137 | 8/1949 | Schudy | 211/119.01 |
| 2,675,201 | 4/1954 | Friel . | |
| 3,550,723 | 12/1970 | Gentry | 182/150 |
| 3,603,428 | 9/1971 | Hanses | 182/222 |
| 4,660,680 | 4/1987 | Potin | 182/150 |
| 5,299,655 | 4/1994 | Margaritis | 182/150 |

FOREIGN PATENT DOCUMENTS

| | | | |
|---|---|---|---|
| 2596441 | 2/1987 | France | 182/45 |
| 0053192 | 3/1985 | Japan | 211/119.01 |

*Primary Examiner*—Alvin Chin-Shue
*Attorney, Agent, or Firm*—James C. Simmons

[57] ABSTRACT

A work platform for use on bridges wherein a plurality of cables extend along a section of the bridge in spaced relation below the deck or roadway and steel support structure of the bridge, which cables are supported at opposite ends by either the steel support structure of the bridge or by the spaced-apart vertical piers of the bridge, and wherein a plurality of platform flooring panels or sections are supported on the cables, extend laterally of the cables, are arranged side-by-side along the section of the bridge such as between the piers and are removably secured to the cables. In one aspect the cables are connected at each end exclusively to the bridge piers, and in another aspect the cables are connected at each end exclusively to the bridge steel structure. In the latter instance, there is provided the capability of installation on skewed or angled bridge sections. In both aspects there is capability of adjustment in vertical and horizontal directions. The platform flooring sections comprise elongated rectangular corrugated decking panels and are arranged in end-to-end overlapping relation transversely of the cables, side-to-side overlapping relation along the bridge and with the corrugations extending transversely of the cables. The corrugations maximize the strength-to-weight ratio of the platform flooring and provide recesses or receptacles to contain debris and facilitate its collection and removal. Each of the platform flooring sections is releasably connected at spaced locations to the supporting cables on which it rests. This is provided by connector assemblies comprising a first part which engages the upper surface of the flooring section and the cable and a second part which engages the upper surface of the flooring section, the two parts being removably connected together through a small opening in the flooring. As a result, individual flooring sections can be removed to provide access through the flooring in emergency or critical situations while at the same time allowing the remainder of the flooring to retain collected debris. A connector assembly also is provided which has a manually operated lever for selectively placing the connector assembly in clamped or un-clamped positions relative to the cable and flooring section. The corrugated decking panels can be provided with hinged plates for covering the corrugations to provide a substantially flat surface over the panels.

8 Claims, 15 Drawing Sheets

WORK PLATFORM FOR USE ON BRIDGES

CROSS REFERENCE TO A RELATED APPLICATION

This application is a continuation-in-part of my pending application Ser. No. 08/506,685 filed Jul. 25, 1995 (now U.S. Pat. No. 5,730,248), issued on Mar. 24, 1998, and entitled "Bridge Platform".

BACKGROUND OF THE INVENTION

This invention relates to the art of working platforms for supporting persons performing work on structures, and more particularly to a new and improved work platform installed below the deck or roadway of a bridge.

It is necessary to periodically clean, repaint and rehabilitate the surfaces of steel bridges to prevent corrosion and deterioration of the steel supporting structure. This, in turn, creates the need to provide a safe and effective support for workmen performing the cleaning and painting of the surfaces beneath the deck or roadway of the bridge, along with concrete removal. In addition, environmental concerns and regulations give rise to the need for containing the debris from the cleaning operation as well as paint residue and spillage.

A number of work platforms for bridges have been proposed but many are complex structures and time consuming to erect and dismantle. Other prior art platforms are not sufficiently rigid or are limited in height, i.e., the distance between platform flooring and bridge steel structure, due to the manner in which they are attached to the bridge. Some prior platforms extend for only a short distance longitudinally of the bridge and are limited in that respect.

It would, therefore, be highly desirable to provide a new and improved work platform for use on bridges which is safe, provides a sufficiently rigid support for workmen standing and walking thereon, which is simple in structure, light in weight, and therefore quick, easy and economical to erect and dismantle, which extends for a significant portion of the length of the bridge and which is effective in containing debris from the cleaning and painting operations performed on the bridge.

A typical bridge includes a deck or roadway and steel structure therebelow which is supported on spaced-apart concrete abutments or piers. It would be highly desirable to provide the foregoing improved work platform which can be connected exclusively to the concrete piers or which can be connected exclusively to the bridge steel structure with the added capabilities of adjustments in vertical and horizontal directions and installation on bridges with skewed or angled sections. It also would be highly desirable to provide the foregoing improved work platform wherein platform flooring sections are secured in place in a safe yet easily removable manner.

SUMMARY OF THE INVENTION

The present invention provides a work platform for use on bridges wherein a plurality of cables extend along a section of the bridge in spaced relation below the deck or roadway and steel support structure of the bridge, which cables are supported at opposite ends by either the steel support structure of the bridge or by the spaced-apart vertical piers of the bridge, and wherein a plurality of platform flooring panels or sections are supported on the cables, extend laterally of the cables, are arranged side-by-side along the section of the bridge such as between the piers and are removably secured to the cables. In one aspect the cables are connected at each end exclusively to the bridge piers, and in another aspect the cables are connected at each end exclusively to the bridge steel structure. In the latter instance, there is provided the capability of installation on skewed or angled bridge sections. In both aspects there is capability of adjustment in vertical and horizontal directions. The platform flooring sections comprise elongated rectangular corrugated decking panels and are arranged in end-to-end overlapping relation transversely of the cables, side-to-side overlapping relation along the bridge and with the corrugations extending transversely of the cables. The corrugations maximize the strength-to-weight ratio of the platform flooring and provide recesses or receptacles to contain debris and facilitate its collection and removal. Each of the platform flooring sections is releasably connected at spaced locations to the supporting cables on which it rests. This is provided by connector assemblies comprising a first part which engages the upper surface of the flooring section and the cable and a second part which engages the upper surface of the flooring section, the two parts being removably connected together through a small opening in the flooring. As a result, individual flooring sections can be removed to provide access through the flooring in emergency or critical situations while at the same time allowing the remainder of the flooring to retain collected debris. A connector assembly also is provided which has a manually operated lever for selectively placing the connector assembly in clamped or un-clamped positions relative to the cable and flooring section. The corrugated decking panels can be provided with hinged plates for covering the corrugations to provide a substantially flat surface over the panels.

The foregoing and additional advantages and characterizing features of the present invention will become clearly apparent upon a reading of the ensuing detailed description wherein:

BRIEF DESCRIPTION OF THE DRAWING FIGURES

DETAILED DESCRIPTION OF THE ILLUSTRATED EMBODIMENT

Figure 1:
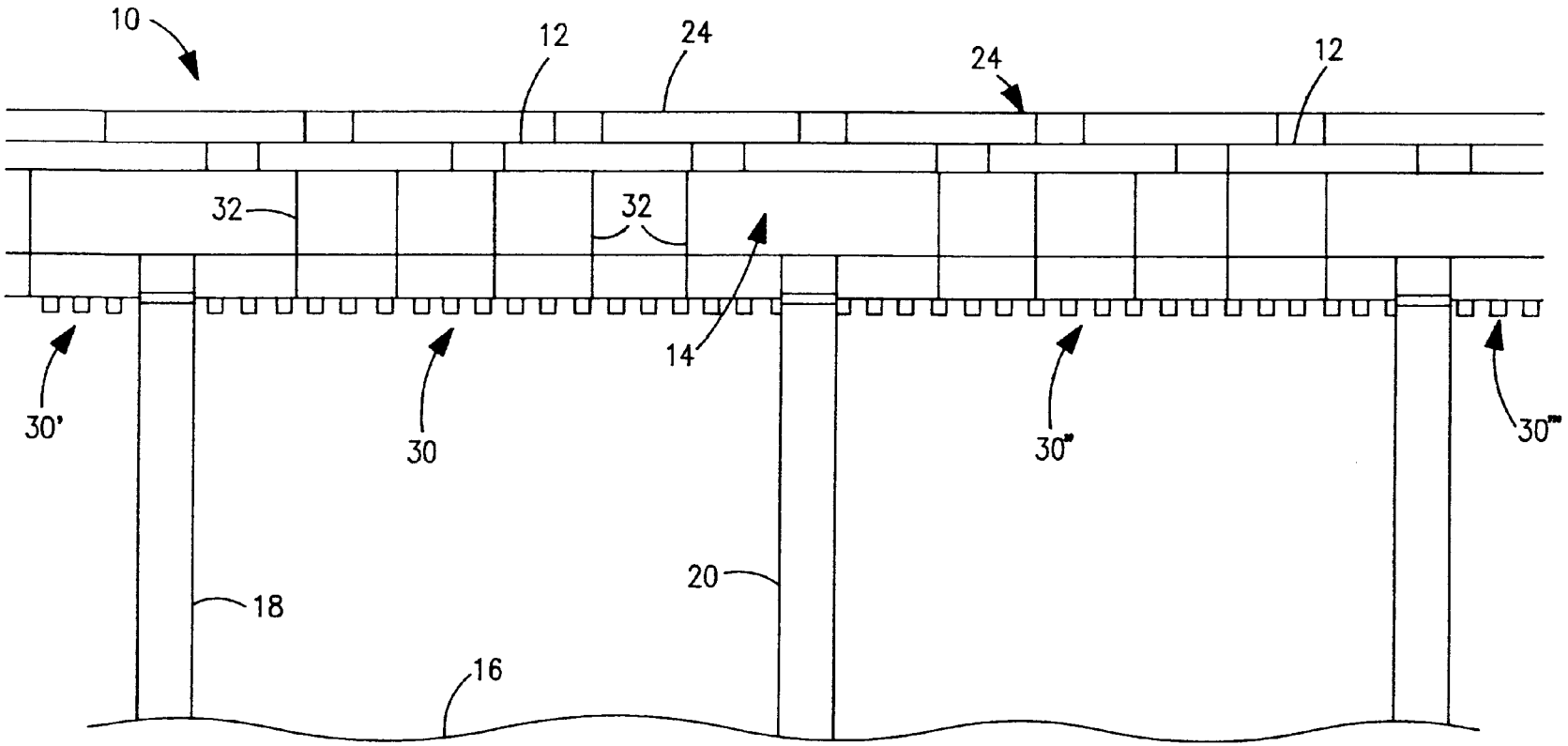
FIG. 1 is a fragmentary side elevational view, partly diagrammatic, of a bridge having a work platform according to the present invention installed thereon.

Referring first to FIG. 1, there is shown a portion of a bridge 10 including a deck or roadway 12 supported by structural steel 14 which, in turn, is supported above the ground 16 by concrete piers or pedestals at regular intervals along the length of the bridge. Three piers 18, 20 and 22 are shown on the bridge section of FIG. 1, although many such piers are included along the total length of an actual bridge. A railing 24 is shown extending along the length of bridge deck 12. The work platform 30 of the present invention in the situation illustrated herein is located below the bridge deck 12 and between the piers 18, 20 and is supported from the piers 18, 20 or the bridge structural steel 14. The platform 30, which will be described presently, includes a plurality of cables (not shown in FIG. 1) extending lengthwise of bridge 10 and supported at opposite ends by piers 18, 20 or by steel structure 14, and a plurality of flooring sections supported by the cables, each extending transversely of the cables and also transversely of bridge 10, and the sections are in side-by-side relation along the length of bridge 10. Each flooring section is removably connected at spaced locations thereon to the cables. The platform can be supported additionally at spaced locations therealong by the bridge structural steel 14 by means of auxiliary support cables, some of which are designated 32 in FIG. 1. While the present description is directed to the single platform 30, a plurality of platforms, three of which are designated 30', 30" and 30'" in FIG. 1 can be provided along the length of bridge 10.

Figure 2:
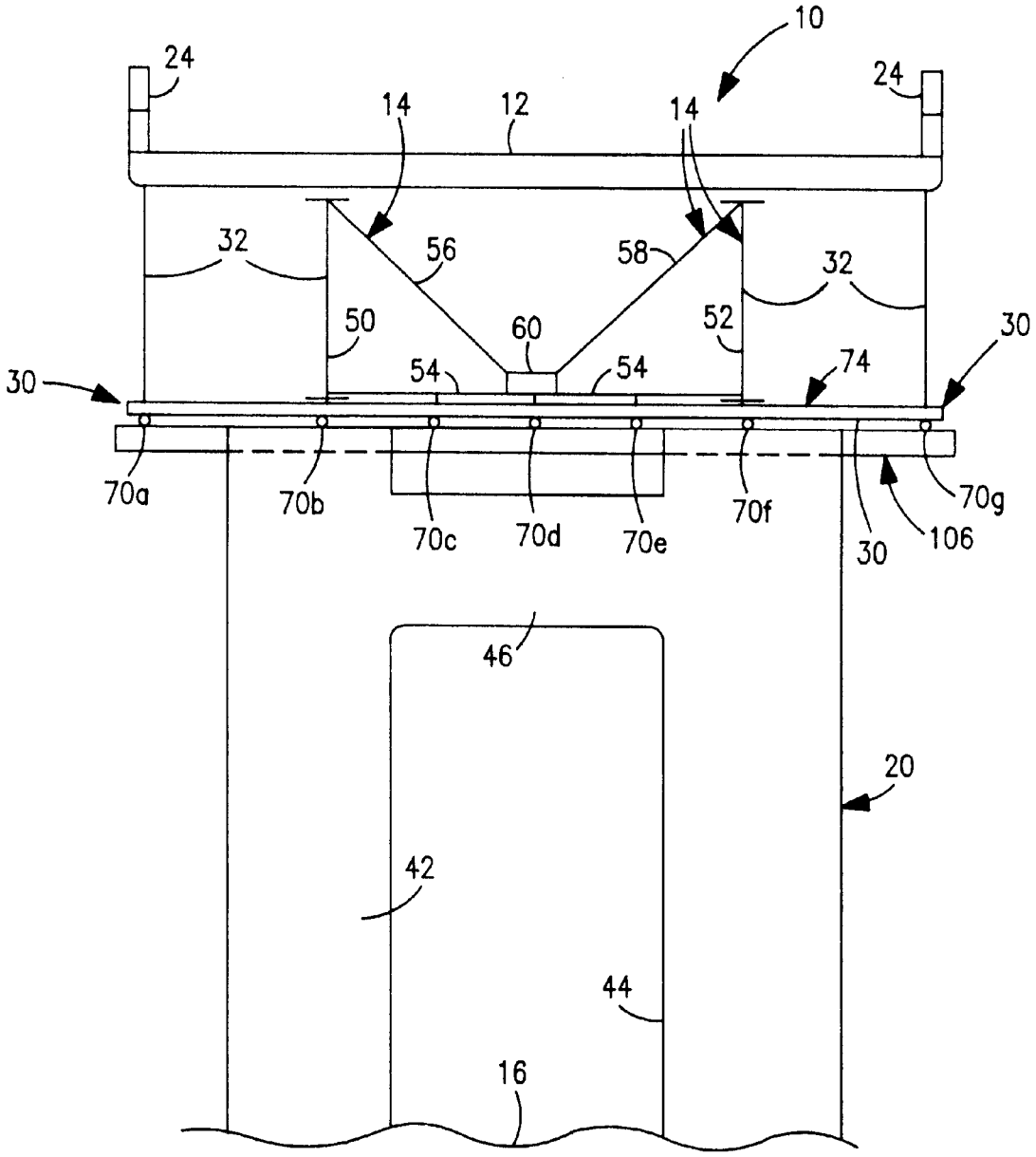
FIG. 2 is a fragmentary cross-sectional view, partly diagrammatic, of the work platform of FIG. 1.

Referring now to FIG. 2, there is shown one of the bridge piers, for example pier 20, which has a pair of vertical pedestals or columns 42 and 44 joined near the upper ends by a central body 46. The bridge structural steel 14 includes sidewalls 50 and 52 which rest on the tops of pedestals 42 and 44, respectively, and which are connected at spaced locations along the length of bridge 10 by a series of assemblies each including a horizontal frame member 54 and inclined frame members 56 and 58 joined at the lower ends to a central plate 60 fixed to frame member 54 and joined at the upper ends to the corresponding sidewalls 50 and 52. Thus, the bridge roadway or deck 12 is supported by the combination of the piers and steel walls 50, 52 and frame assemblies in a known manner. In addition, the walls 50, 52 and frame assemblies provide the surfaces which must be periodically cleaned, such as by abrasive blasting or the like, and painted.

As shown in FIG. 2, the supporting cables 70 of the platform 30 of the present invention extend longitudinally of bridge 10 between the piers and are spaced apart substantially equally in a transverse direction relative to bridge 10. Thus, cables 70 are disposed in a plane substantially parallel to the plane of bridge deck 12. By way of example, in an illustrative bridge having a width of about 32 feet and a distance between piers of about 140 feet, seven steel cables 70*a*–70*g* each one-half inch in diameter are provided. The cables 70 are secured to a structure of bridge 10 so that the plane of the cables is at a desired distance below the portion of bridge 10 upon which work is to be performed. In the platform illustrated in FIGS. 1–3, cables 70*a* –70*g* are attached at opposite ends to piers 18 and 20 by compression clamp assemblies which will be described. The platform flooring, generally designated 74 in FIG. 2, rests on and is supported by cables 70*a*–70*g*. Flooring 74 comprises a plurality of sections or panels each releasably connected to corresponding cables 70 in a manner which will be described in detail presently.

Figure 3:
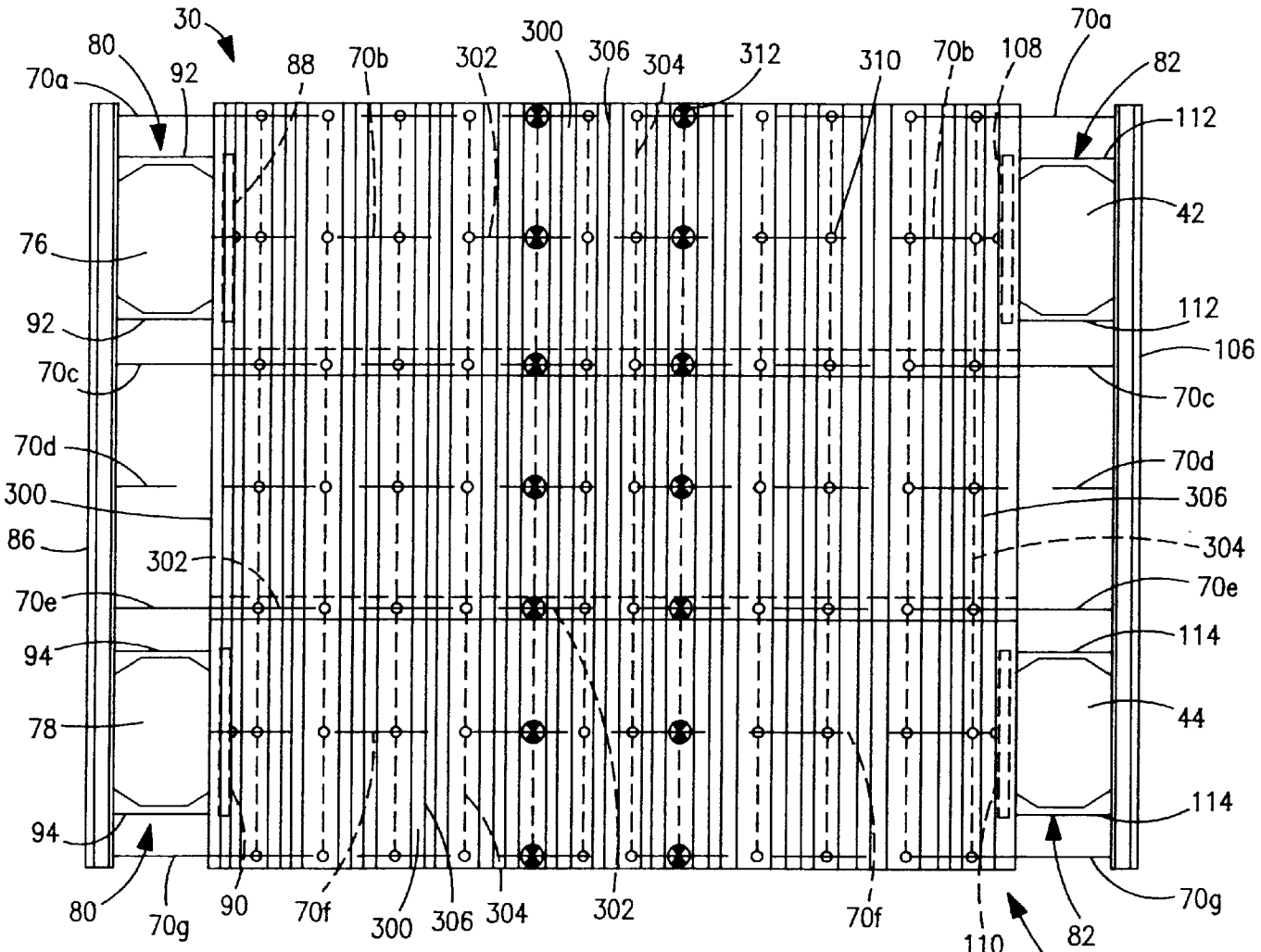
FIG. 3 is a plan view of the work platform of FIG. 1.

The plan view of FIG. 3 illustrates a form of clamping assemblies for attaching opposite ends of cables 70 to the bridge piers 18 and 20. The clamping assemblies shown in FIGS. 1–3 are the subject of the above-referenced U.S. Pat. No. 5,730,248 and are described herein briefly for the purpose of providing a proper background for the detailed description of the cable connector assemblies of this invention which will follow. The pedestals 42 and 44 of pier 20 are shown in FIG. 3. Pier 18 likewise has two pedestals designated 76 and 78 in FIG. 3. A first compression clamping assembly generally designated 80 secures all of the cables 70 at one end thereof, i.e. the left-hand end as viewed in FIG. 3, to pedestals 76 and 78 of pier 20. A second compression clamping assembly generally designated 82 and identical to assembly 80 secures all of the cables 70 at the opposite end thereof, i.e. the right-hand end as viewed in FIG. 3, to pedestals 42 and 44 of pier 20. Clamping assembly 80 comprises a first member or I-beam 86 extending transversely of bridge 10 and contacting both pedestals 76 and 78 on one side thereof and second and third members or I-beams 88 and 90 also extending transversely but each contacting only a corresponding one of the pedestals 76 and 78 and on the opposite side thereof. Members 86 and 88 are clamped to pedestal 76 by a plurality of threaded connecting rods 92 which are tightened to provide the required amount of compression force. Similarly, members 86 and 90 are clamped to pedestal 78 by a plurality of threaded connecting rods 94 which are tightened to provide the required amount of compression force. Thus, I-beam 86 contacts the left-hand surfaces of pedestals 76 and 78 as viewed in FIG. 3 and I-beams 88 and 90 contact the right-hand surfaces of pedestals 76 and 78, respectively, as viewed in FIG. 3. Cables 70*b* and 70*f* are connected at one end to I-beams 88 and 90, respectively, and the remaining cables 70*a*, 70*c*–70*e* and 70*g* are connected to I-beam 86. The clamping assembly and the manner of connecting cables 70 thereto will be described in further detail presently.

In a similar manner, clamping assembly 82 comprises a first member or I-beam 106 extending transversely of bridge 10 and contacting both pedestals 42 and 44 on one side thereof and second and third members or I-beams 108 and 110 also extending transversely but each contacting only a corresponding one of the pedestals 42 and 44 and on the opposite side thereof. Members 106 and 108 are clamped to pedestal 42 by a plurality of threaded connecting rods 112 which are tightened to provide the required amount of compression force. Similarly, members 106 and 110 are clamped to pedestal 44 by a plurality of threaded connecting rods 114 which are tightened to provide the required amount of compression force. Thus, I-beam 106 contacts the right-hand surfaces of pedestals 42 and 44 as viewed in FIG. 3, and I-beams 108 and 110 contact the left-hand surfaces of pedestals 42 and 44 as viewed in FIG. 3. Cables 70*b* and 70*f* are connected at the ends to I-beams 108 and 110, respectively, and the remaining cables 70*a*, 70*c*–70*e* and 70*g* are connected to I-beams 106.

Figure 4:
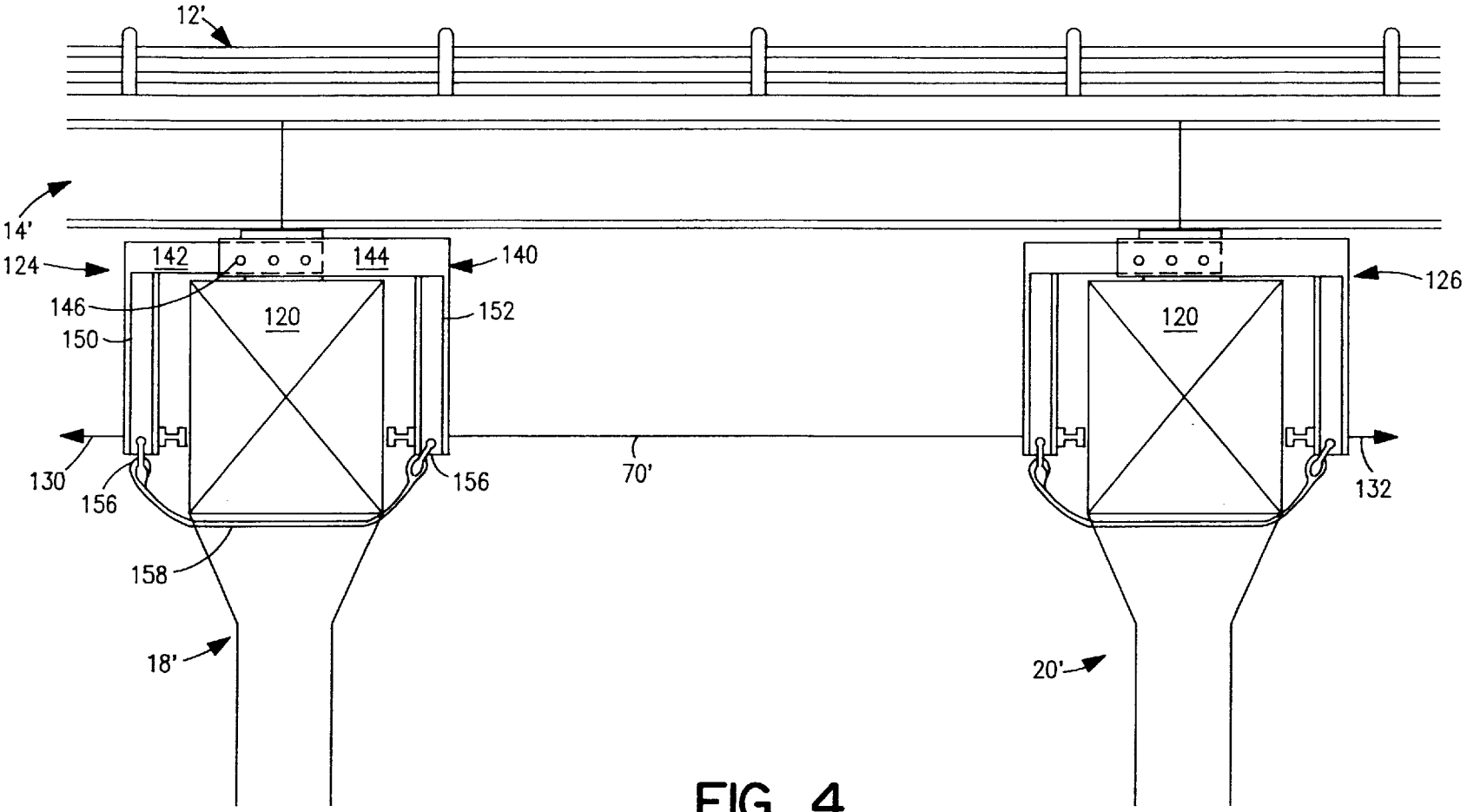
FIG. 4 is a fragmentary side elevational view showing a pair of clamp assemblies according to one embodiment of the present invention for use with the work platform of FIGS. 1–3.

Referring now to FIGS. 4–8 there is shown a clamp assembly according to the present invention for securing cables 70 of platform 30 exclusively to the piers of a bridge. Depending upon the structure of a particular bridge and/or the work to be performed on it, there are situations where only the concrete piers and none of the bridge steel structure 14 can be utilized to support platform 30. As shown in FIG. 4, a pair of piers 18' and 20' support the bridge structural steel 14' below bridge deck 12', and piers 18' and 20' have upper cap portions 118 and 120, respectively. A clamp assembly generally designated 124 is secured to pier cap 118 and an identical clamp assembly generally designated 126 is secured to pier cap 120. The cables, one of which is designated 70' in FIG. 4, for supporting platform 30' are secured at opposite ends to clamp assemblies 124 and 126. A corresponding plurality of cables, one of which is designated 130, can be connected between clamp assembly 124 and an identical clamp assembly (not shown) on a neighboring pier (not shown) for supporting another platform (not shown) in an identical manner. Similarly, another corresponding plurality of cables, one of which is designated 132, can be connected between clamp assembly 126 and an identical clamp assembly (not shown) on a neighboring pier (not shown) for supporting another platform (not shown) in an identical manner. Clamp assemblies 124 and 126 are identical and for convenience only clamp assembly 124 will be described in detail in connection with FIGS. 4–8.

Figure 5:
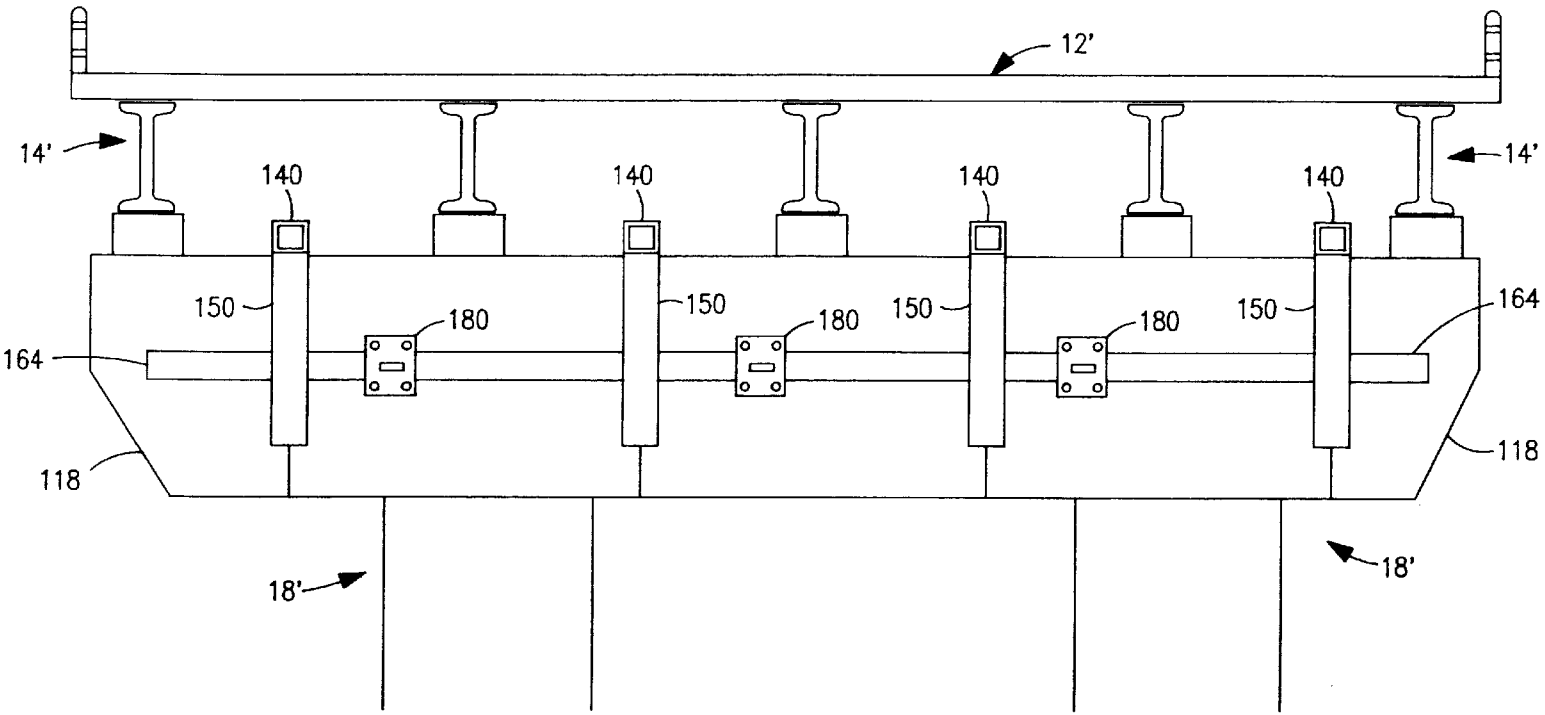
FIG. 5 is a fragmentary end elevational view of one of the clamp assemblies of FIG. 4.

Clamp assembly 124 includes a plurality of pier brackets, each generally designated 140, secured to upper cap portion 118 of pier 18' at laterally spaced locations therealong as shown in FIG. 5. By way of example, in an illustrative work platform, pier brackets 140 are spaced apart about 7–8 feet. Each pier bracket 140 comprises a pair of telescoping or relatively reciprocal hollow steel members 142 and 144 which fit relatively snugly but movably one within the other. The members 142, 144 rest on the top surface of pier cap portion 118 and after being adjusted to the width of pier cap portion 118 are locked against any relative movement by pins or bolts 146 shown in FIG. 4. A pair of light duty I-beams or posts 150 and 152 depend from the outer ends of members 142 and 144, respectively, and are fixed thereto such as by welding. Each I beam 150 and 152 and its corresponding member 142 and 144, respectively, define substantially a right angle therebetween. The lower end of each I-beam 150, 152 is provided with an opening to receive a hook 156 or the like to enable a cable 158 to be connected to the lower ends of I-beams 150, 152 and to be tightened against the bottom of pier cap portion 118 to prevent tipping or similar movement of each pier bracket 140.

The plurality of pier brackets 140 support a horizontally disposed beam 164 to which the plurality of platform supporting cables are secured at the ends thereof and which is vertically adjustable in the following manner. By way of example, in an illustrative work platform, beam 164 is a W6×16 beam that extends for the entire width of the work platform. Beam 164 is supported in a vertically adjustable manner on each pier bracket depending beam or part 150 by the arrangement shown in FIGS. 7 and 8. Beam 164 is supported by a plurality of angle brackets 170, one for each part 150, which in turn is held in place by a pair of bolt 172 and nut 174 fasteners on each side of post 142 which engage a plate 178 on the opposite face of post 142. Thus, by means of the arrangement shown in FIGS. 7 and 8 beam 164 is supported on posts 142 and can be raised or lowered simply by changing the location of each angle 170 and plate 178 combination on the corresponding part 142.

Figure 6:
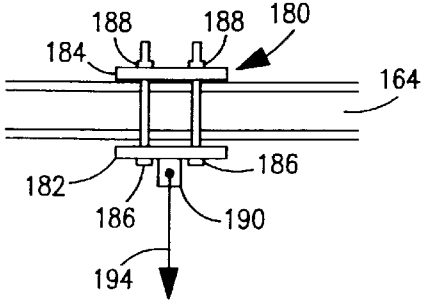
FIG. 6 is an enlarged fragmentary plan view of the means for providing horizontal adjustment of the cable locations in the assemblies of FIGS. 4 and 5.
Figure 7:
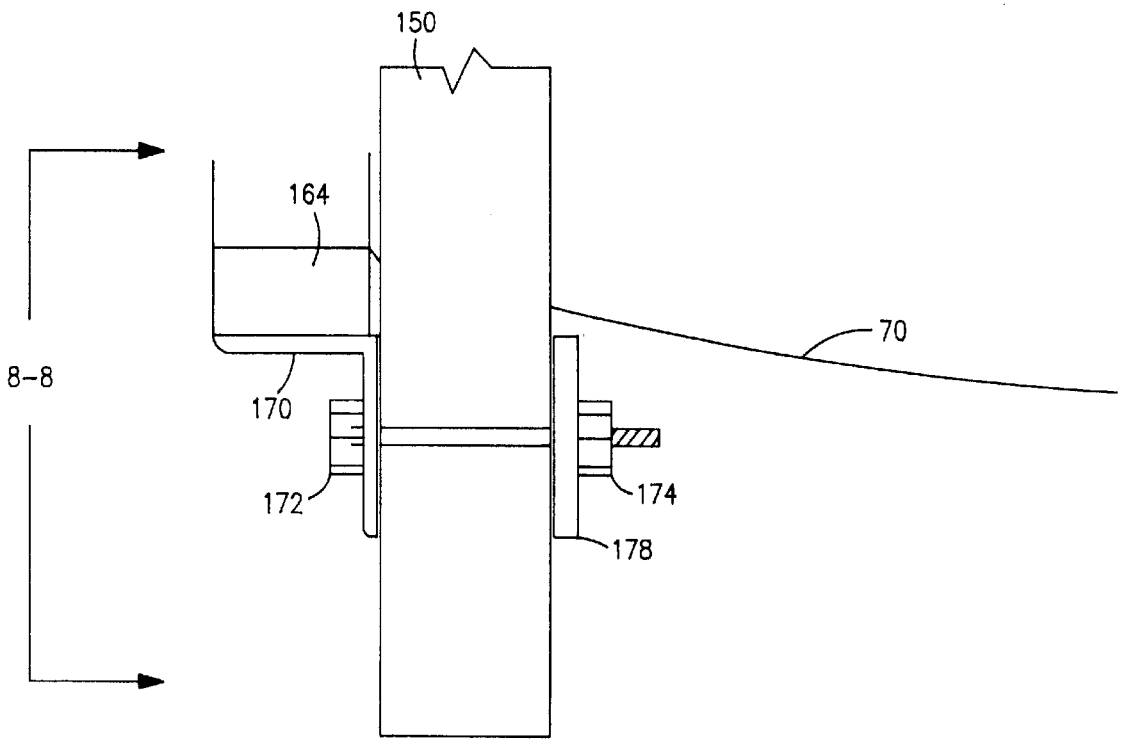
FIG. 7 is an enlarged fragmentary elevational view of the means for providing vertical adjustment of the cable locations in the assemblies of FIGS. 4 and 5.
Figure 8:
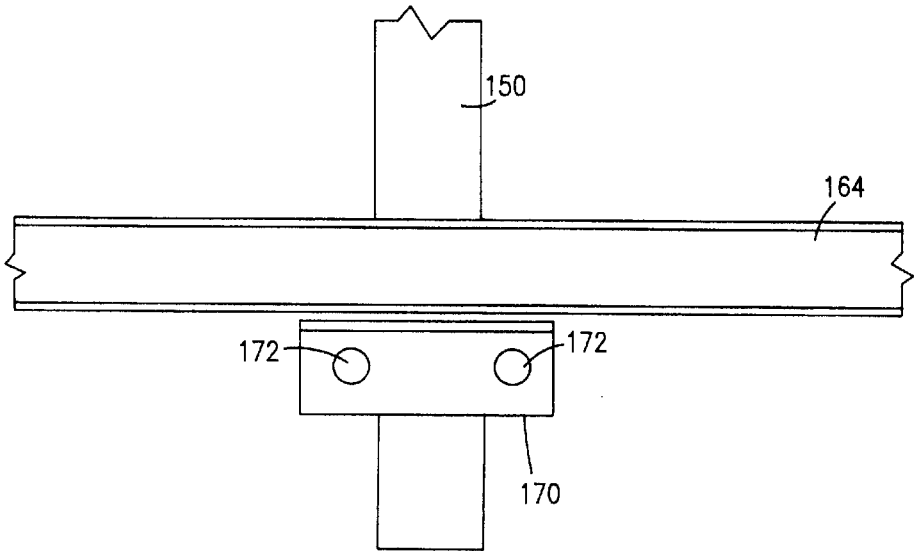
FIG. 8 is a fragmentary elevational view taken about on line 8—8 in FIG. 7.

The work platform supporting cables are connected at ends thereof to cable connector assemblies 180, one assembly for each cable, which are mounted on beam 164. The locations of connector assemblies 180 on beam 164 are adjustable in a horizontal direction so that the spacing between adjacent cables can be varied. As shown in FIG. 6, each connector assembly 180 includes a pair of plates 182 and 184 clamped on beam 164 by a plurality of bolt 186 and nut 188 type fasteners. A shackle plate 190 is provided as one of the plates 182 for connection to one end of the cable designated 194 in FIG. 6.

Thus, the clamp assembly shown in FIGS. 4–8 secures the cables of the work platform exclusively to the piers of a bridge. The horizontal spacing between each of the cables is individually adjustable. The vertical location of all of the cables is adjustable simultaneously. In other words, the distance between the plane in which the cables lie and the plane of the bridge deck is adjustable. As a result, the vertical location of the platform flooring is adjustable relative to the location of the bridge deck and steel structure to accommodate various types of maintenance and repair operations on the bridge.

Figure 9:
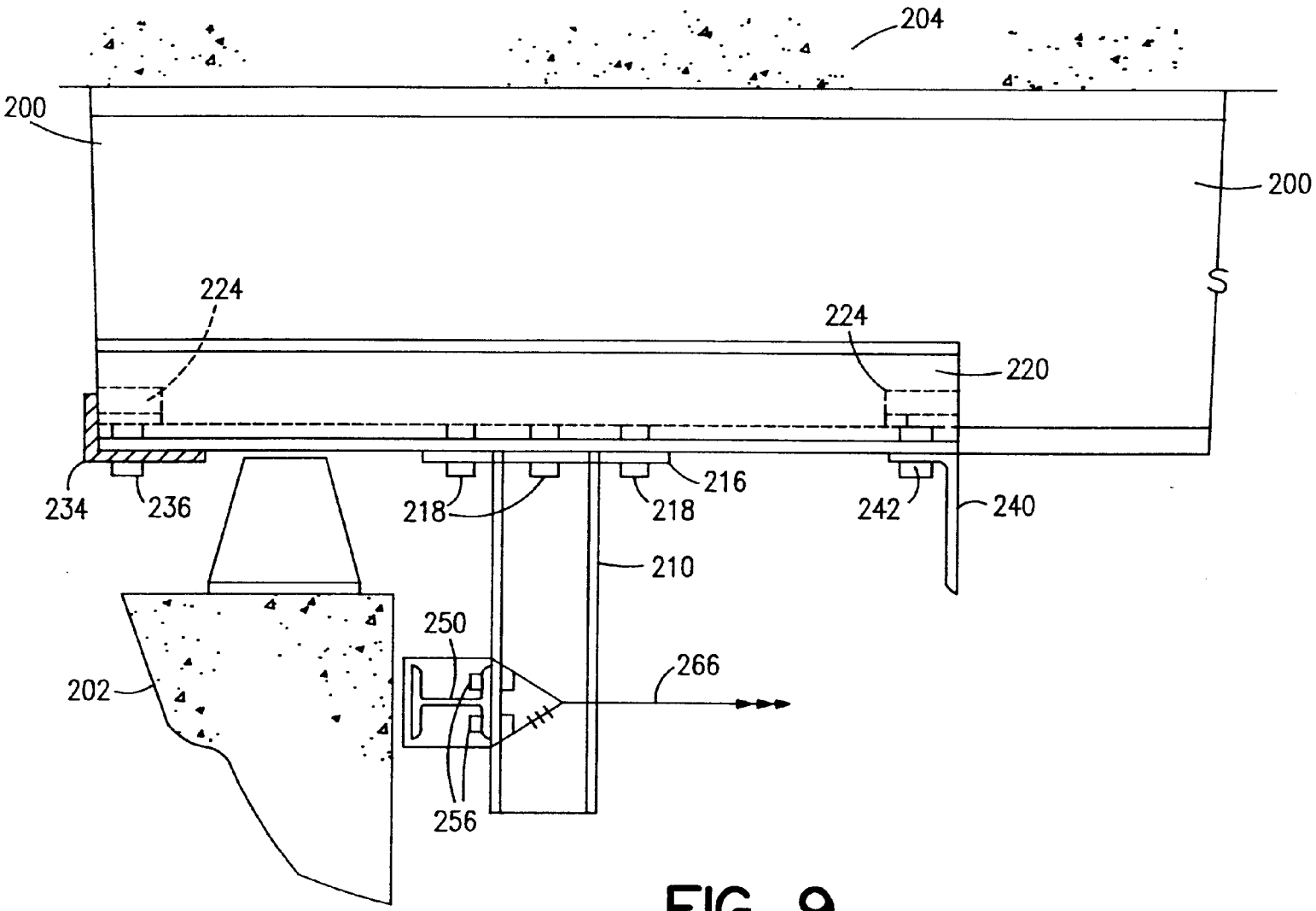
FIG. 9 is a fragmentary side elevational view showing a clamp assembly according to another embodiment of the present invention for use with the work platform of FIGS. 1–3.
Figure 10:
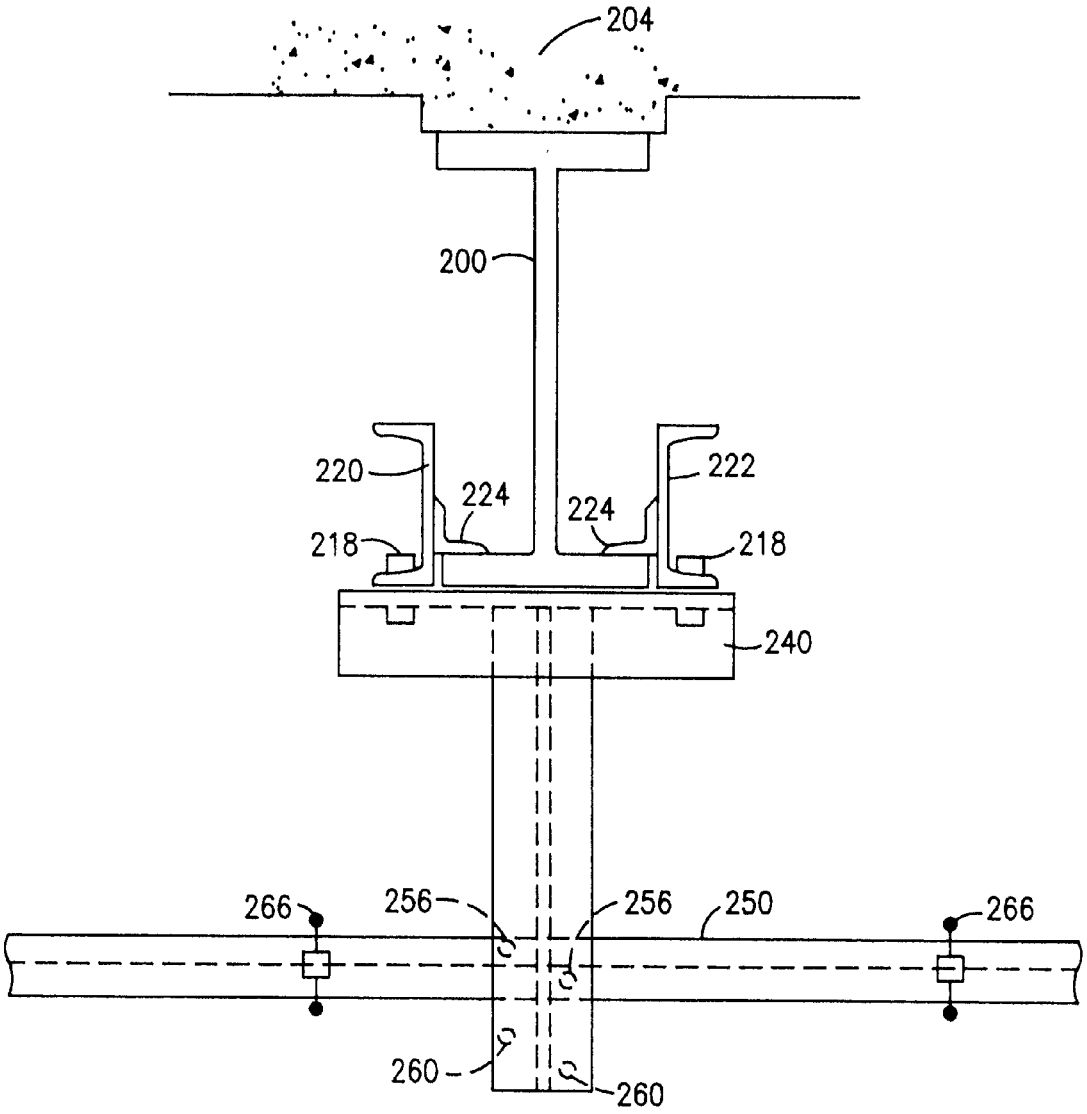
FIG. 10 is a fragmentary end elevational view of the clamp assembly of FIG. 9.

FIGS. 9 and 10 show a clamp assembly according to the present invention for securing cables 70 of platform 30 exclusively to the bridge steel structure. Depending upon the structure of a particular bridge and/or the work to be performed on it, there are situations where only the bridge steel structure and none of the bridge concrete piers or abutments can be used to support platform 30. As shown in FIG. 9, a bridge girder or stringer 200 is supported at one end by a bridge concrete abutment or pier 202, and stringer 200, in turn, supports the bridge deck 204. The opposite end of stringer 200 is supported on a similar pier or abutment (not shown) and a plurality of such girders are provided, extending longitudinally of the bridge and spaced apart laterally of the bridge at appropriate distances.

The clamp assembly according to this embodiment of the present invention comprises a generally vertically disposed post 210 which is mounted at one end to stringer 200 and depends therefrom. While for convenience in illustration only one post 210 is shown in FIGS. 9 and 10, the clamp assembly includes a plurality of such posts, one for each girder or stringer of the bridge on which the work platform is installed. Post 210 is mounted at one end thereof to stringer 200 in the following manner. A plate 216 is welded on the end of post 210 and is secured by bolt and nut type fasteners 218 to a pair of channel members 220 and 222 which extend longitudinally along and are mounted to opposite sides of stringer 200. In particular, each channel member 220 and 222 has a pair of angle members, each designated 224 fixed thereto such as by welding and located at opposite ends thereof. One flange of each angle member 224 is welded to the web of the corresponding channel member, as shown in FIG. 10, and the other flange of each angle member 224 rests on and is supported by the lower horizontal flange of girder 200. Another angle member 234 is provided at the end of girder 200 adjacent pier 202 and fixed to the flanges of girder 200 and channel members 220, 222 by bolt and nut type fasteners 236 to prevent movement longitudinal movement of channels 220, 222 to the left as viewed in FIG. 9. At the opposite ends of channels 220, 222 an angle member 240 is fixed to the flanges of girder 200 and channels 220, 222 by bolt and nut fasteners 242 to support the channels 220, 222 in place.

The clamp assembly further comprises a generally horizontally disposed beam 250 connected to post 210 for receiving the ends of the cables which support the platform flooring. Beam 250 is connected at a selected vertical location to post 210 by bolt and nut type fasteners designated 256. Vertical adjustment of the location of beam 250 on post 210 is provided by a series of openings 260 on the flanges of post 210 as shown in FIG. 10. As previously mentioned, a plurality of posts like post 210 are provided, one depending from each girder or stringer of a bridge on which the work platform is installed, and beam 250 is connected to each of the posts in a manner identical to the connection to post 210 shown in FIG. 9 and 10. Alternatively, a series of such beams can be provided, extending over the width of the platform and connected to the posts. Cables such as those designated 266 in FIGS. 9 and 10 are secured to beam 250 in a suitable manner.

By way of example, in an illustrative bridge platform, post 210 is a W10×33 I beam having a length of about 4.0 feet, plate 216 has a thickness of about ½ inch, each channel member 220 and 222 is a C10×13 channel having a length of about 5.0 feet, each angle member 224 has flanges about 3.0 inches long and about 3.0 inches wide and about ½ inch thick, the flanges of angle member 234 are about 4.0 inch long and about 8.0 inch long, respectively, and about 1.2 inch thick, angle member 240 has the same dimensions as angle member 234, beam 250 is a W8×18 I beam, cables 266 have diameter of about ⅝ inch, and the bolt and nut fasteners 218, 236 and 242 include ¾ inch bolts.

Figure 11:
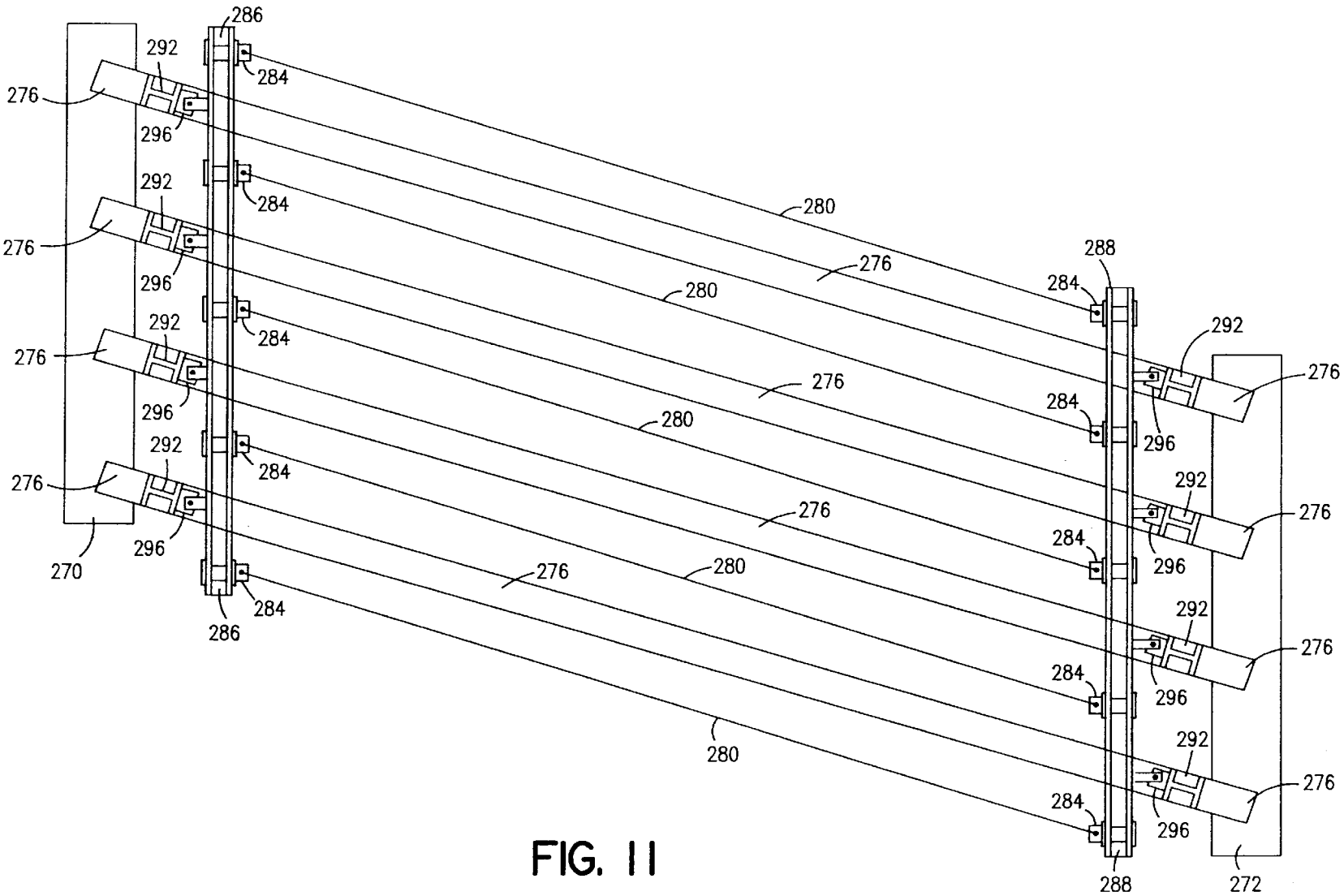
FIG. 11 is a plan view showing a clamp assembly according to another embodiment of the present invention for use with the work platform of FIGS. 1–3.
Figure 13:
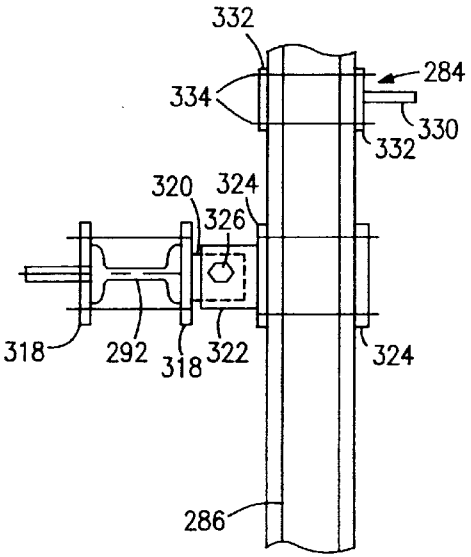
FIG. 13 is a fragmentary plan view of the assembly of FIG. 12.
Figure 12:
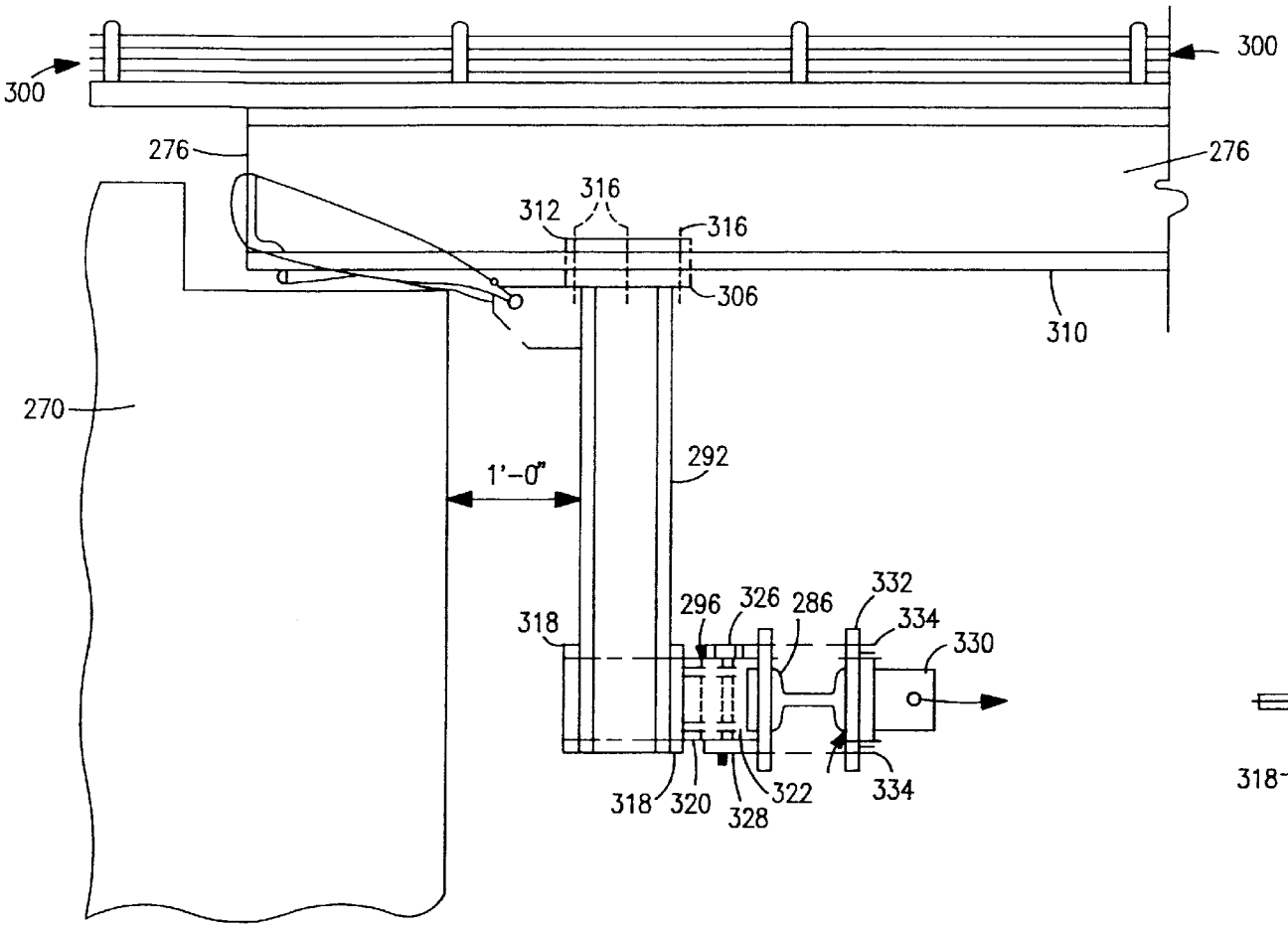
FIG. 12 is a fragmentary side elevational view of a portion of the clamp assembly of FIG. 11.

FIGS. 11–13 show a clamp assembly for securing cables 70 of work platform 30 exclusively to the bridge steel structure and having the added capability for installation on bridges with skewed or angled sections. A skewed or angled bridge section is illustrated in the plan view of FIG. 11 wherein a pair of offset bridge piers or abutments 270 and 272 support a series of girders or stringers each designated 276 in a skewed or angled arrangement. A series of cables 280, similar to cables 70 of platform 30, which support the work platform of the present invention are connected at opposite ends thereof to cable connector assemblies 284 which, in turn, are mounted on horizontally disposed beams 286 and 288 located near corresponding ones of the bridge piers or abutments 270 and 272, respectively, as viewed in FIG. 11. Beams 286 and 288, in turn, are supported by an arrangement including a plurality of vertically disposed post members 292, which are mounted at the upper ends of corresponding ones of the girders 276 in a manner which will be described. Post members 292 are connected to corresponding ones of the beams 286 and 288 by swivel connector assemblies 296 which will be described in detail presently.

FIG. 12 shows in further detail the arrangement including one of the post members 292 for supporting beam 286. Abutment 270 supports girder 276 which along with the other girders and abutment 272 (shown in FIG. 11) supports bridge deck 300. A plate 306 is welded to the upper end of post member 292 and is of sufficient size to extend across and outwardly of the lower flange 310 of girder 276. A pair of plates, one of which is designated 312 in FIG. 12, are provided and placed on the top surfaces of girder flange 310. The plates are of sufficient size to extend outwardly beyond the girder flange 310. Then the combination of the larger plate 306 and pair of smaller plates is fastened together and against girder flange 310 by a series of bolt and nut type fasteners 316 on both sides of girder flange 310, thus clamping the upper end of post member 292 to girder flange 310. A swivel plate assembly 296 then is clamped by plates 318 bolted to post member 292 at a selected vertical location thereon. Post 292 is provided with a series of openings (not shown) to receive bolts at various vertical locations to provide vertical adjustment of the location of assembly 296. As shown in FIGS. 12 and 13, each swivel plate assembly comprises a first part 320 clamped and bolted to post member 292, a second part 322 secured to beam 286 by a clamp assembly 324 and a pivotal connection between parts 320 and 322 provided by a headed bolt or pin 326 held therein by a nut 328 threaded thereon. Part 322 is a hollow member having aligned apertures to receive pin 326, and part 320 is a plate with a central aperture to receive pin 326 and which is received in part 322 with room for pivotal movement therein. FIGS. 12 and 13 also show in further detail one of the cable connector assemblies 284 comprising an apertured plate 330 welded to a clamp assembly 332 fixed to beam 286 by bolt and nut type fasteners 334. The construction shown in FIGS. 12 and 13 is the same for each of the posts 292, cable connector assemblies 284 and swivel connector assemblies 296 in the arrangement of FIG. 11.

Thus, the swivel connectors 296 in the arrangement of FIGS. 11–13 accommodate installation of the work platform of the present invention on angled or skewed bridge sections. By way of example, in an illustrative work platform, each post member 292 can be W8×15 small I-beam or square tube. Each post 292 can be tied back to the bridge bearing by ⅝ inch cable for additional security if desired.

Figure 14:
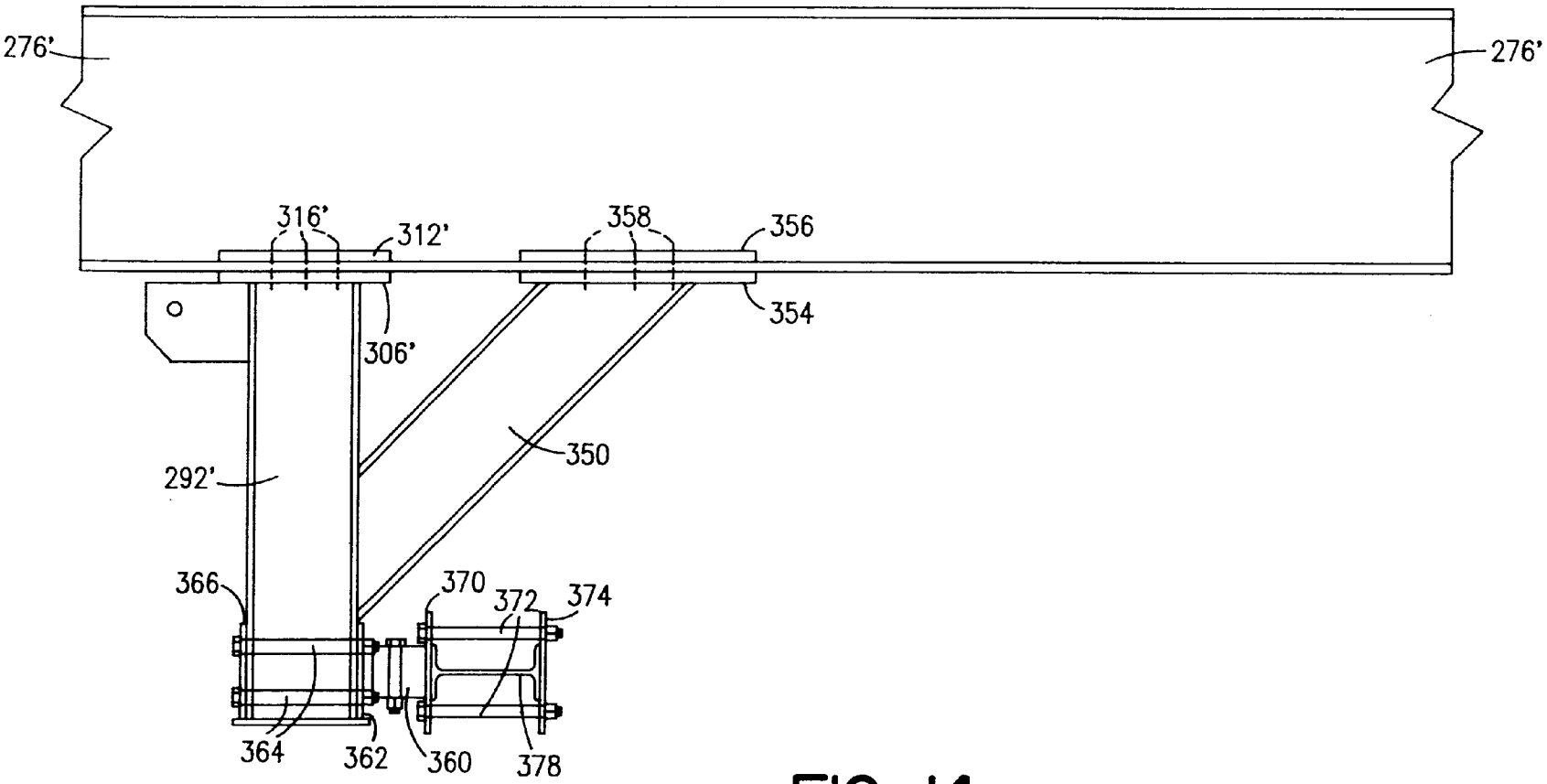
FIG. 14 is a fragmentary side elevational view of an alternative form of the clamp assembly of FIGS. 11 and 12.

FIG. 14 shows an alternative form of post construction for use in an arrangement like that of FIGS. 11–13. Post 292' is similar to post 292 in the previous arrangement and is fastened to girder 2761 by a similar arrangement of large plate 306', small plates 312' and fasteners 316'. A reinforcing member 350 is fixed at one end to post 292' by welding or bolt and nut type fasteners (not shown) and extends upwardly at an angle whereupon it is fastened to the lower flange of girder 276' by a similar arrangement of large plate 354 welded to the end of member 350 and a pair of small plates 356 fastened in a clamp-like arrangement to the girder flange by bolt and nut type fasteners 358. A swivel bracket 360 is welded to a plate 362 which is joined by bolt and nut type fasteners 364 to another plate 366 such that the two plates 362 and 366 clamp on post 292' to secure swivel bracket 360 thereto. The clamping arrangement allows vertical adjustment of the location on post 292'. By way of example, in an illustrative arrangement, swivel bracket 360 is like the assembly 296 in FIGS. 12 and 13 consists of a hollow steel member 4"×4"×¼"×4" long welded onto a 7"×9"×½" plate and two 4"×4"×½" plates welded to another 7"×9"×½" plate and connected by a 1⅞"×7" long bolt secured with a nut. Swivel bracket 360 also is welded to a plate 370 which is joined by bolt and nut type fasteners 372 to another plate 374 such that the two plates 370 and 374 clamp on a horizontally disposed beam 378 to secure swivel bracket thereto. Beam 378 extends for the entire width of the work platform and has the supporting cables (not shown) secured thereto in a manner similar to the preceding arrangements. By way of example, in an illustrative work platform, post 292' is a W8×18 beam and beam 378 is a W8×15 beam. An apertured plate 380 can be fixed such as by welding to post 292' for connection of a reinforcing cable to the bridge abutment or pier, if desired for added security.

Referring again to FIG. 3, the platform flooring 74 comprises a plurality of elongated rectangular panels each designated 300 which are arranged in end-to-end overlapping relation transversely of bridge 10 and cables 70, as indicated by the broken lines 302 in FIG. 3, and which panels 300 are arranged in side-by-side overlapping relation longitudinally of bridge 10 and cables 70, as indicated by the broken lines 304 in FIG. 3. Panels 300 are corrugated decking panels with the corrugations extending transversely of cables 70 as indicated at 306 in FIG. 3. Having corrugations 306 extending transversely of cables 70 maximizes the rigidity and strength of flooring 74 and prevents any buckling of the panels 300. Each of the platform flooring sections or panels 300 is releasably connected at spaced locations to the supporting cables 70 on which it rests. This is provided by connector assemblies generally indicated at 310 in FIG. 3 and which will be described in detail presently. As a result, individual flooring sections or panels 300 can be removed to provide access through the flooring in emergency situations. For example, if a worker becomes seriously ill or injured, one or more flooring sections 300 can be quickly and easily removed thereby allowing the worker to be lowered safely to the ground below. In addition, collected debris remains in the corrugations of the removed panel and is not lost from containment within the area of the platform.

Some of the connector assemblies, i.e. those designated 312 in FIG. 3, also have the capability of an additional or auxiliary connection to the bridge structural steel 14 and will be described in detail presently.

Each panel 300 has a pair of side edges which are joined by a pair of end edges. Corrugations 306 extend longitudinally along each panel 300 and substantially parallel to side edges thereof. The corrugations 306 of all the panels 300 in flooring 74 extend transversely of cables 70 so as to provide the required strength and rigidity of the platform 30.

Each of the panels 300 comprising flooring 74 includes a plurality of openings extending therethrough for making connection to cables 70. The number and location of openings will depend upon the size of panels 300 and the distance between cables. Each panel 300 includes a first pair of openings located near one end and a second pair of openings located near the opposite end. Each of the openings is elongated and disposed with the longitudinal axis thereof substantially parallel to corrugation 306 and thus transversely of cables 70. The openings in the panels 300 enable the connector assemblies 310, 312 to contact or engage both the cables 70 and panels 300 in a manner releasably connecting the panels to the cables.

Figure 15:
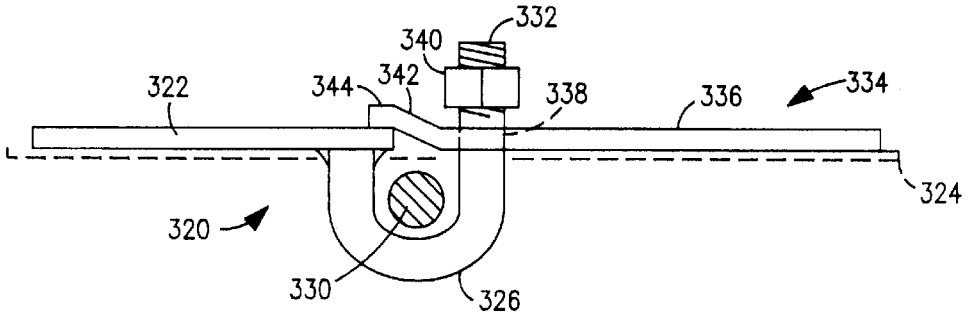
FIG. 15 is a fragmentary side elevational view of a connector assembly according to one embodiment of the present invention.
Figure 16:
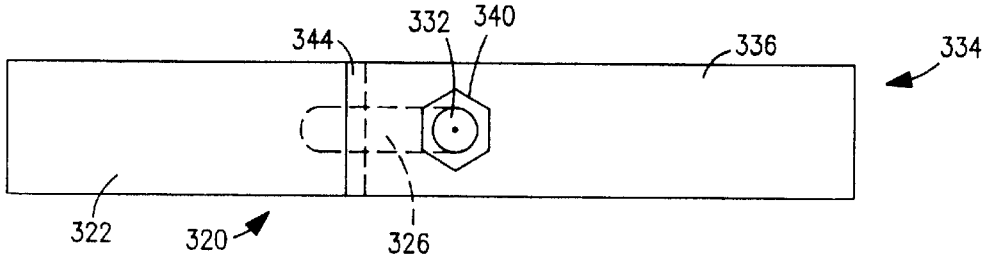
FIG. 16 is a plan view thereof.
Figure 17:
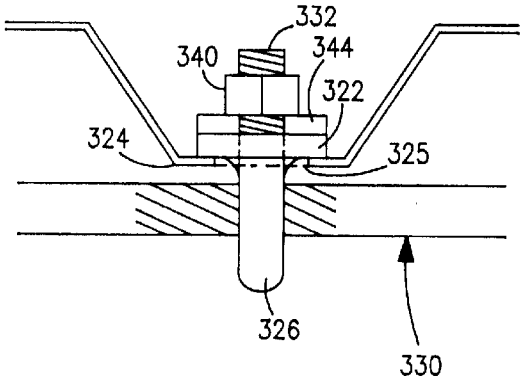
FIG. 17 is a fragmentary end elevational view thereof.

One form of connector assembly according to the present invention is shown in FIGS. 15–17 and includes a first part 320 in the form of a rectangular plate 322 which engages the upper surface of the platform flooring indicated at 324 in FIG. 15 and a substantially U-shaped book formation 326 extending from body 322 for engaging one of the cables, designated 330 in FIG. 15, and having a threaded free end 332. The connector assembly includes a second part 334 generally in the form of a rectangular plate 336 having an opening 338 therethrough for receiving therethrough the threaded end 332 of book formation 326 of the first part 320 so that a nut 340 can be threaded on the free end 332 to fasten the first and second parts together. A major portion of plate 336 engages the upper surface of flooring 324 and is substantially co-planar with plate 322. The end portion 342 of plate 336 is bent or angled slightly as shown in FIG. 15 and terminates in a lip or end flange 344 which contacts the upper surface of plate 322. This provides a positive engagement between the two parts when nut 340 is tightened and precuts any sagging of the parts.

The connector assembly of FIGS. 15–17 is installed in the following manner. First the part 320 is manipulated to insert hook formation 326 through the slot 325 in flooring 324 around cable 330 and back up through the slot 325 in flooring 324. Next, the second part 334 is positioned to receive threaded end 332 through opening 338 whereupon nut 340 is installed and tightened on end 332 to fasten the assembly together. This assembly securely holds the flooring panels onto the platform support cables.

Figure 20:
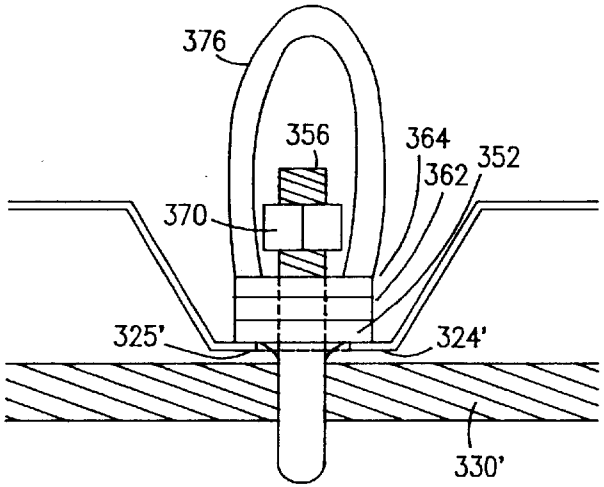
FIG. 20 is a fragmentary end elevational view thereof.
Figure 18:
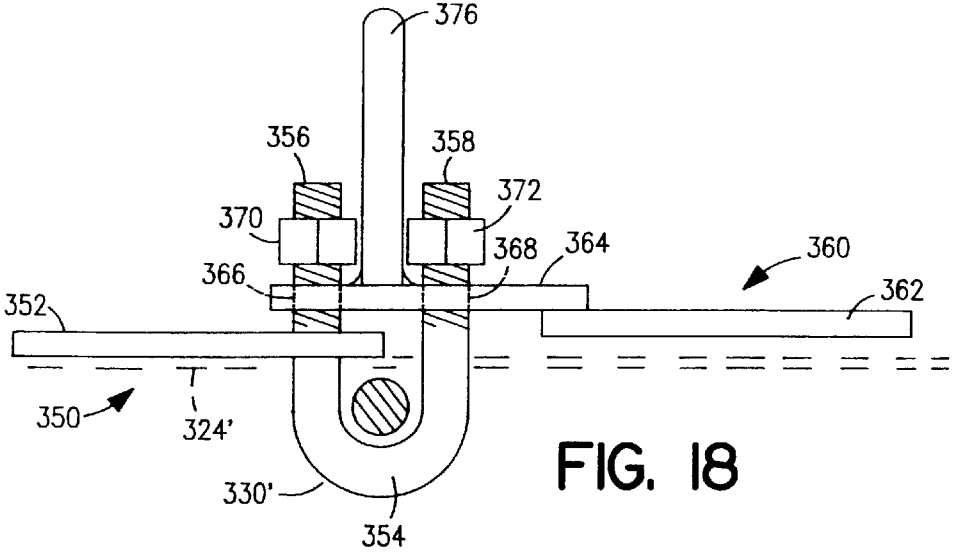
FIG. 18 is a fragmentary side elevational view of a connector assembly according to another embodiment of the present invention.
Figure 19:
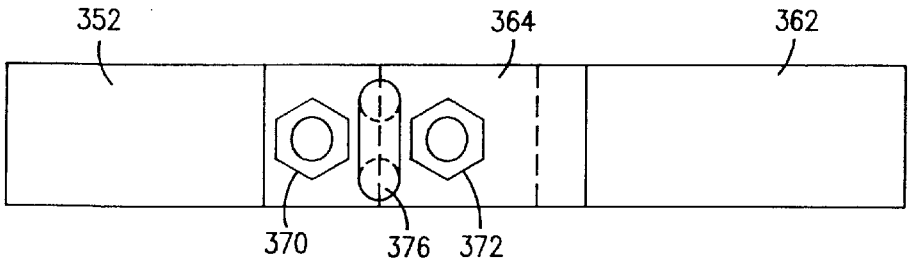
FIG. 19 is a plan view thereof.

Another form of connector assembly according to the present invention is shown in FIGS. 18–20 and includes provision for connection to auxiliary cables for extra support. The connector assembly includes a first part 350 in the form of a rectangular plate 352 which engages the upper surface of the platform flooring indicated at 324' in FIG. 18 and a substantially U-shaped hook formation 354 which extends through body 352 for engaging are of the cables, designated 330' in FIG. 18, and having a pair of threaded free ends 356 and 358. The connector assembly includes a second part 360 including a pair of rectangular plates 362 and 364 welded together in overlapping relation along the ends thereof to define a step-like structure. Plate 364 is provided with a pair of openings 366 and 368 therethrough to receive therethrough the threaded ends 356 and 358, respectively, of hook formation 354 of the first part 350 so that nuts 370 and 372 can be threaded on the free ends 356 and 358, respectively, to fasten the first and second parts together. Plate 352 of the first part 350 and plate 364 of the second part 360 contact the upper surface of flooring 324' when the parts are fastened together, and the lower surface of plate 362 in the vicinity of opening 366 contacts the upper surface of plate 352 to provide a stable structure. A hook or loop formation 376 is welded on the upper surface of plate 362 to provide connection to an auxiliary support cable (not shown) extending from the bridge deck or steel structure.

The connector assembly of FIGS. 18–20 is installed in the following manner. First the part 350 is manipulated to insert hook formation 354 through the slot 325' in flooring 324' around cable 330' and back up through the slot 325' in flooring 324'. Next the second part is positioned to receive threaded ends 356 and 358 through openings 366 and 368, respectively, in plate 362 whereupon nuts 370 and 372 are installed and tightened on ends 356 and 358, respectively, to fasten the assembly together. This connector assembly securely holds the flooring panels onto the platform support cables. In addition, an auxiliary support cable (not shown) secured at one end to the bridge deck or steel structure is provided with an eye hook on the opposite end is hooked onto formation 376 to provide extra support for the platform. In the connector assembly of FIGS. 18–20 the auxiliary cable (not shown) is pulling the assembly upwardly in line with the platform supporting cable 330' thereby providing a balanced arrangement which avoids any torquing or bending of parts of the assembly of the auxiliary cable connection were offset from the location of the supporting cable.

Figure 21:
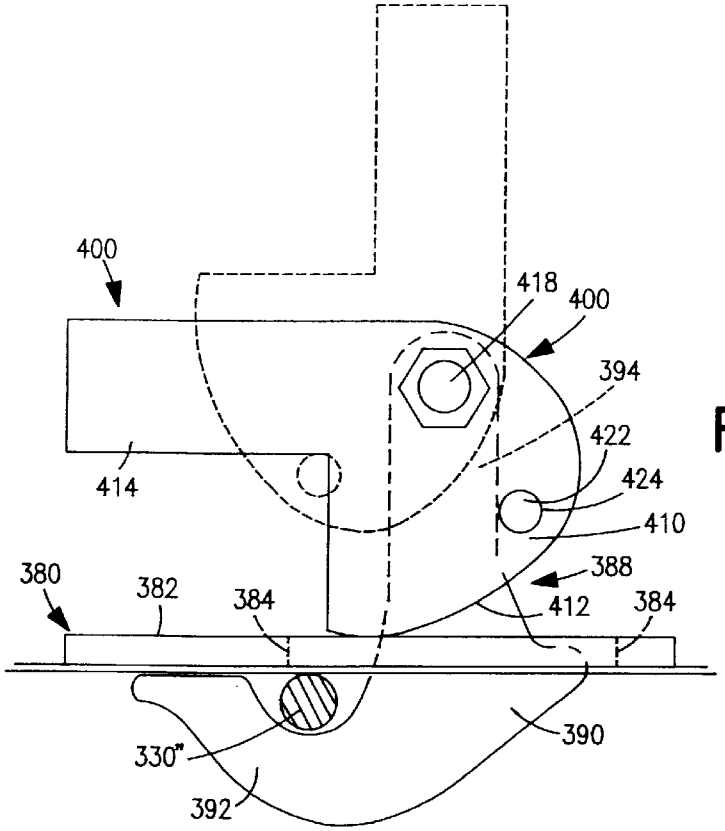
FIG. 21 is a fragmentary side elevational view of a connector assembly according to another embodiment of the present invention.
Figure 22:
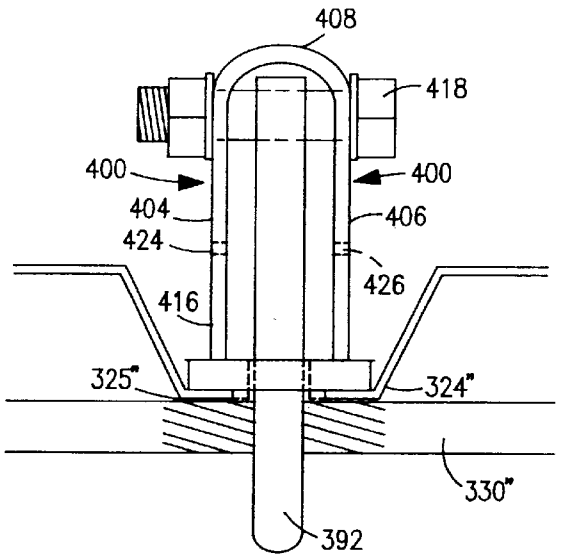
FIG. 22 is a fragmentary end elevational view thereof.
Figure 23:
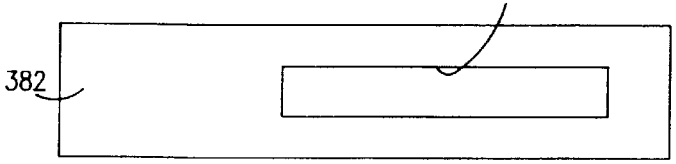
FIG. 23 is a plan view of the spacer plate in the connector of FIGS. 21 and 22.

Another form of connector assembly according to the present invention is shown in FIGS. 21–23 and is characterized by a manually-operated lever for tightening the connector and supporting cable together. The connector assembly includes a first part 380 in the form of a spacer plate 382 having an elongated slot 384 therein which corresponds in size to the slot 325" in flooring 324". The length and width of spacer plate 382, however, are of sufficient size that plate 382 covers slot 325". The connector assembly includes a second part 388 for engaging supporting cable 330" and which is generally in the form of a hook. In particular, part 388 includes a central body portion 390, a curved, hooked-shaped portion 392 extending from one end of body 390 and shaped to engage cable 330" as shown in FIG. 21, and a connector portion 394 extending from another end of body 390. The connector assembly also includes a lever or operator member 400 pivotally connected to connector portion 394 of the second part 388. Lever 400 has a first position shown in solid lines in FIG. 21 which tightens the second part 388 against cable 330" and a second position shown in broken lines in FIG. 21 which releases the second part from cable 330". In particular, lever 400 has a generally U-shaped end-wise configuration as shown in FIG. 22 having a pair of spaced-apart flange-like sections 404 and 406 joined by a curved central web-like section 408. Each flange section, for example section 404 shown in FIG. 21, includes an operator portion 410 having a curved, cam-like surface 412 for bearing against the upper surface of spacer plate 382 in the locked position shown in solid lines in FIG. 21, and a handle or grip portion 414 extending from operator portion 410. Lever 400 is pivotally connected to part 388 by means of a bolt 418 which extends through aligned apertures in the end of connector portion 394 of part 388 and in the sections 404 and 406 of lever 400.

The connector assembly of FIGS. 21–23 is installed in the following manner. Spacer plate 382 is placed in position and part 388 is inserted through slot 384 in spacer plate 382 and slot 325" in flooring 324" and the hook-shaped portion 392 is engaged on cable 330" as shown in FIG. 21. During this operation, lever 400 is in the broken line position shown in FIG. 21. Next, lever 400 is moved by hand to the solid line position of FIG. 21. This applies downward force on spacer plate 382 and pulls hook portion 392 upwardly against cable 330" thereby tightening the assembly. As a result, the connector assembly securely holds flooring 324" on the supporting cable 330". A pin 422 or nut and bolt can be inserted through the aligned apertures 424 and 426 in flange sections 404 and 406, respectively, to hold lever 400 in place for added safety. When it is desired to disassemble the arrangement or to remove a flooring section, pin 422 is removed and lever 400 simply moved to the broken line position of FIG. 21 whereupon the part 388 is removed from contacting cable 330".

The connector assembly of FIGS. 21–23 has the advantages that no welding of parts is required, it can be assembled prior to installation on the work platform, i.e. does not have to be assembled on site, it is relatively light in weight, and it is relatively easy and quick to install.

The platform sections or panels 300 and the connector assemblies are installed to provide a completed platform 30 in the following manner. The panels 300 are placed and arranged on the cables 70 by workmen using scaffolds or the like supported by the bridge 10. Panels 300 are placed on the supporting cables 70 so that the corrugations 306 are disposed transversely of the cables 70. Panels 300 are arranged in a row and in end-to-end overlapping relation transversely of the cables 70. The panels 300 are located so that the openings are aligned with various ones of the cables 70. Furthermore, with adjacent ones of the panels 300 being in end-to-end overlapping relation, the openings of the overlapping portions of adjacent panels 300 in a row are aligned with each other and with the corresponding cables 70.

Next, the connector assemblies are installed manually by the workmen. The connector assemblies can be any of the connector assemblies described in connection with FIGS. 15–23 and they are installed in the manner previously described. The foregoing operation is repeated for each of the connector assemblies in each of the panels along the row. Then the panels 300 of the next row are installed, the row extending transversely of the cables 70 and the panels of the next row being adjacent sideways to the panels of the first row. The panels of this next row are in end-to-end overlapping relation in the same manner as the panels of the first row. In addition, the panels of this next row are in side-to-side overlapping relation with the panels of the first row as shown in FIG. 3. The connector assemblies are installed in the panels of this next row in a manner similar to that of the first row. The foregoing installation of rows of panels 300 and installation of connector assemblies is continued in a direction longitudinally of the cables 70 until the platform 30 is completed. Connector assemblies of the type are shown in FIGS. 18–20 are installed at spaced locations, for example about 20 feet, over the surface of platform 30, and auxiliary cables such as cables 32 are connected between those assemblies and bridge structural steel 32.

By way of example, in an illustrative platform, the overall width is about 32 feet or slightly less than the width of the bridge deck 12 and the overall length of the platform is about 140 feet which is approximately the span between piers 18, 20. Panels 300 are rigid type B corrugated steel decking panels each 11 feet in length and 3 feet in width. The panels 300 are 22 gage, 1½ inch deep ASTM A446 steel having a yield strength of FY=33 KSI (minimum). A minimum panel overlap of 6 inches in longitudinal and lateral directions is provided. Cables 70 are seven in number, each ½ inch in diameter and spaced apart about 5 feet. Cables 70 are 6×19 IWRC cable of plain steel with a breaking strength of 41,200 pounds or greater. Each panel 300 is connected at two locations to the corresponding cable. The location of platform 30 is about 11½ feet below bridge deck 12. The typical maximum applied load for which platform 30 is designed is 11 pounds per square foot. The cables 70 are supported every 20 feet by the auxiliary support cables such as those designated 32.

Platform 30 of the present invention by virtue of the combination of support cables 70 and corrugated decking panels 300 is safe, provides a sufficiently rigid support for workmen to stand and walk on and is relatively simple in structure and light in weight. Rigidity is important in that workmen can walk along platform 30 with no lowering. The corrugations 306 enhance the strength to weight ratio of panels 300. In addition, the corrugations facilitate containment of debris. The provision of the connector assemblies in cooperation with the openings in the panels provide a quick, easy and effective way to both erect and dismantle the bridge platform of the present invention The provision of individual panels 300 releasably connected to cables 70 provides convenient and quick access through the flooring 74 in emergency situations. Thus in such situations it is not necessary to cut through the platform flooring which otherwise could destroy the integrity of debris containment provided by enclosures such as that shown in FIG. 16. Furthermore, the time required to cut through flooring could have serious consequences in emergency and critical situations, and such cutting could impair the structural integrity of the platform and therefore its safety.

Figure 24:
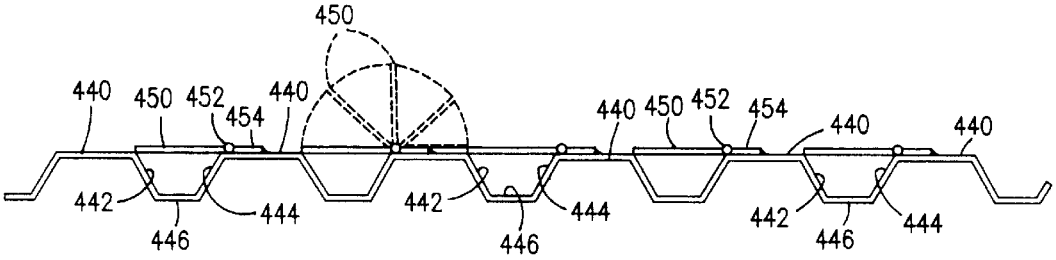
FIG. 24 is a side elevational view of an alternative form of flooring for the work platform of the present invention.
Figure 25:
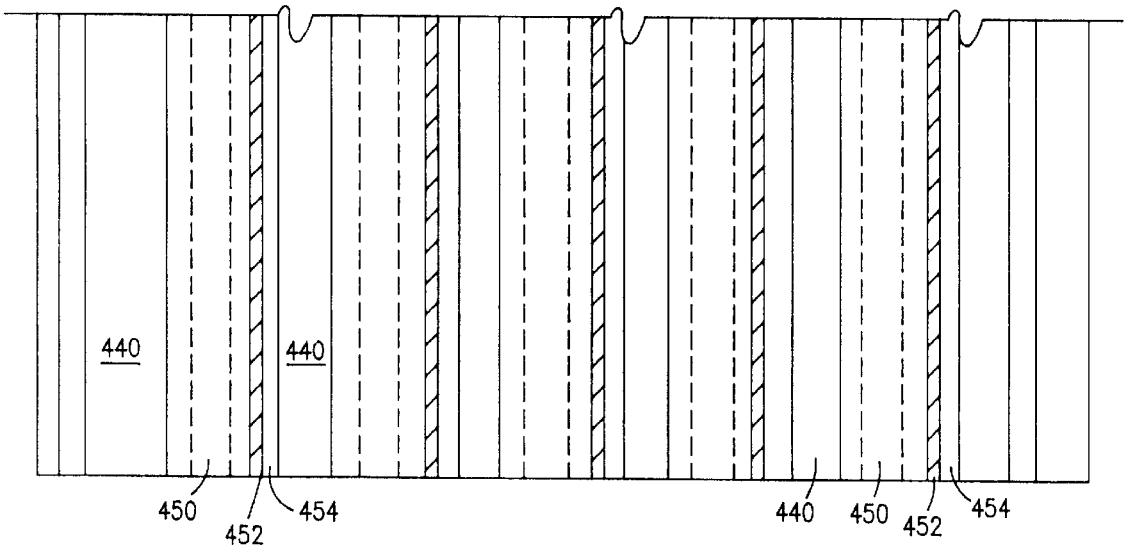
FIG. 25 is a plan view thereof.

FIGS. 24 and 25 show an alternative form of flooring for the work platform of the present invention. The corrugated decking panels of flooring 74 include a series of flat upper surfaces designated 440 in FIG. 24 which are separated by a series of troughs or depressions defined by downwardly inclined walls 442 and 444 which meet flat lower surfaces 446. The connector assemblies previously described are located in the troughs below the plane of the upper surfaces 440. In order to provide a more flat surface to walk on and to move equipment therealong, the flooring is modified by providing a series of flat, plate-like covers hinged to the upper surfaces 440 for covering the troughs or depressions between the surface 440. In particular each cover comprises a thin rectangular plate 450 having a length equal to that of flooring 74 and a width slightly greater than the maximum width of a trough or depression in flooring 74. One edge of cover 450 is joined to a hinge 452 which, in turn, is joined to a plate 454 of relatively shorter width and of the same length as plate 450 and which is fixed such as by welding to the adjacent upper surface 440 of the flooring. Actually, the entire combination may be viewed as a hinge with plates 450 and 454 each being a hinge leaf and joined by the hinge knuckle assembly 452. The foregoing is provided on each of the troughs or depressions defined in flooring 74. If desired, a strip of magnetic material can be provided along the lower portion of the free edge of each cover 450 to hold the cover down and prevent lifting as persons walk along flooring 74. Thus, after the connector assemblies are installed, each of the hinged covers 450 is flipped over to the position shown in FIG. 24 covering its corresponding corrugation thereby providing a flat uniform surface which is easier to walk on and move equipment therealong. In addition, by covering the corrugations, debris is confined to the flat upper surface making cleanup easier.

It is therefore apparent that the present invention accomplishes its intended objects. While embodiments of the present invention have been described in detail that is for the purpose of illustration and not limitation.

What is claimed is:

1. A platform for installation below a deck of a bridge and extending along a section of a bridge for supporting persons performing work on a bridge and for collecting debris resulting from the work, said platform comprising:

a) a plurality of cables for extending along a bridge and in spaced relation to each other and in a plane substantially parallel to the plane of a bridge deck;

b) means at each end of said cables for securing said cables to a bridge so that the plane of the cables is at a desired distance below the portion of a bridge upon which work is to be performed;

c) a plurality of flooring sections each extending transversely of the cables and resting on said cables, said flooring sections being arranged in side-by-side relation longitudinally of the cables; and d) means for releasably securing said flooring sections to said cables comprising a plurality of connector assemblies each comprising a first part which engages the upper surface of the flooring section and the cable, a second part which engages the upper surface of the flooring section and means extending through the flooring section for releasably connecting the two parts together, said first part comprising a plate-like body and a substantially U-shaped hook formation extending from said body for engaging the cable and having a threaded free end and said second part comprising a plate-like body having an opening therethrough for receiving therethrough said threaded end of said hook formation of said first part so that a nut can be threaded on said free end to fasten said first and second parts together, said second part having a first portion substantially co-planer with said first part and a second portion overlapping a portion of said first part so as to provide a stable assembly.

2. A platform for installation below a deck of a bridge and extending along a section of a bridge for supporting persons performing work on a bridge and for collecting debris resulting from the work, said platform comprising:

a) a plurality of cables for extending along a bridge and in spaced relation to each other and in a plane substantially parallel to the plane of a bridge deck;

b) means at each end of said cables for securing said cables to a bridge so that the plane of the cables is at a desired distance below the portion of a bridge upon which work is to be performed;

c) a plurality of flooring sections each extending transversely of the cables and resting on said cables, said flooring sections being arranged in side-by-side relation longitudinally of the cables; and d) means for releasably securing said flooring sections to said cables comprising a plurality of connector assemblies each comprising a first part which engages the upper surface of the flooring section and the cable, a second part which engages the upper surface of the flooring section and means extending through the flooring section for releasably connecting the two parts together, said first part comprising a plate-like body and a substantially U-shaped hook formation extending from said body for engaging the cable and having first and second threaded free ends, said first threaded free end extending through said plate-like body, and said second part comprising a pair of plates joined in stepwise formation and having an opening therethrough for receiving therethrough said second threaded free end of said hook formation of said first part so that a pair of nuts can be threaded on said first and second threaded free ends to fasten said first and second parts together, said second part having a first portion substantially co-planer with said first part and a second portion overlapping a portion of said first part so as to provide a stable assembly.

3. A work platform according to claim 2, further including means for connection to one end of an auxiliary supporting cable, the other end of which is secured to the bridge to provide additional support for said platform, said connection means being located so that the auxiliary supporting cable is in general alignment with the cable engaged by said second part of the connector assembly.

4. A platform for installation below a deck of a bridge and extending along a section of a bridge for supporting persons performing work on a bridge and for collecting debris resulting from the work, said platform comprising:

a) a plurality of cables for extending along a bridge and in spaced relation to each other and in a plane substantially parallel to the plane of a bridge deck;

b) means at each end of said cables for securing said cables to a bridge so that the plane of the cables is at a desired distance below the portion of a bridge upon which work is to be performed;

c) a plurality of flooring sections each extending transversely of the cables and resting on said cables, said flooring sections being arranged in side-by-side relation longitudinally of the cables, said flooring sections comprising corrugated elongated rectangular decking panels with the corrugations extending transversely of the cables; and d) a plurality of flat cover members hinged to said flooring sections and located so as to cover said corrugations thereby defining a substantially flat surface over said flooring sections.

5. A platform according to claim 4, wherein said means for securing said cables includes a plurality of vertical beams for attaching to a bridge supporting structure, an horizontal beam to which ends of said cables are attached, and means for swivelly connecting said horizontal beam to each of said vertical beams to accommodate installation of said platform on skewed bridge sections.

6. A work platform for installation below a deck of a bridge and for extending along a section of the bridge for supporting persons performing work on a bridge and for collecting debris resulting from the work, the bridge including a metal supporting structure below the deck thereof, said platform comprising:

a) a plurality of cables for extending along a bridge in spaced relation to each other in a plane substantially parallel to a plane of a bridge deck;

b) means at each end of said cables for securing said cables exclusively to a metal supporting structure of a bridge so that the plane of the cables is at a desired distance below the portion of a bridge upon which work is to be performed;

c) a plurality of flooring sections each extending transversely of the cables and resting on said cables, said flooring sections being arranged in side-by-side relation longitudinally of the cables; and d) said means for securing said cables including means for adjusting the location of the plane containing all of the cables relative to a portion of a bridge upon which work is to be performed, wherein said means for securing said cables comprises post means for mounting at one end to said metal supporting structure of said bridge to depend therefrom; and beam means connected to said post means and disposed generally in the plane of said cables for receiving the ends of said cables secured thereto, the work platform further including swivel means for connecting said beam means to said post means to accommodate installation of said work platform on skewed bridge sections.

7. A work platform according to claim 6, further comprising means for adjustably varying the height of said cables and thereby vary the platform height.

8. A work platform according to claim 6, further comprising means for adjusting height of all of said cables together to vary the height of said platform.

* * * * *